US006123269A

United States Patent [19]

Schmitkons et al.

[11] Patent Number: 6,123,269

[45] Date of Patent: Sep. 26, 2000

[54] LIQUID DISPENSING SYSTEM AND METHOD FOR ELECTROSTATICALLY DEFLECTING A CONTINUOUS STRAND OF HIGH VISCOSITY VISCOELASTIC NONCONDUCTIVE LIQUID

[75] Inventors: James W. Schmitkons, Lorain; Jeffrey S. Noss, Bay Village, both of Ohio

[73] Assignee: Nordson Corporation, Westlake, Ohio

[21] Appl. No.: 09/183,470

[22] Filed: Oct. 30, 1998

[51] Int. Cl.[7] ..... B05B 5/035; B05B 5/14

[52] U.S. Cl. ..... 239/3; 239/708; 118/640

[58] Field of Search ..... 239/690, 3, 708, 239/697, 695; 118/640; 427/516

[56] References Cited

U.S. PATENT DOCUMENTS

| | | | |
|---|---|---|---|
| 4,749,125 | 6/1988 | Escallon et al. | 239/3 |
| 4,854,506 | 8/1989 | Noakes et al. | 239/698 X |
| 4,904,174 | 2/1990 | Moosmayer et al. | 425/174.8 |
| 5,086,973 | 2/1992 | Escallon et al. | 239/3 |
| 5,122,048 | 6/1992 | Deeds | 425/174.8 |
| 5,165,601 | 11/1992 | Rodenberger et al. | 239/3 |
| 5,685,482 | 11/1997 | Sickles | 239/698 X |

OTHER PUBLICATIONS

United Air Specialists, Inc., *Totalstat Electrostatic MicroAtomizer,* Brochure, 1989.

*Primary Examiner*—Kevin Weldon
*Attorney, Agent, or Firm*—Wood, Herron & Evans, L.L.P.

[57] ABSTRACT

A non-contact electrostatic liquid dispensing system and method for dispensing continuous, high viscosity viscoelastic nonconductive liquid strands in a controlled manner onto a substrate. An applicator or gun having a charging electrode introduces an electrostatic charge to the high viscosity viscoelastic nonconductive liquid and as charged continuous fibrous strand of high viscosity viscoelastic nonconductive material. One or more electric fields are generated about the discharge path to impart a variety of movements or patterns to the charged continuous fibrous strand of high viscosity viscoelastic nonconductive liquid.

6 Claims, 2 Drawing Sheets

FIG. 2
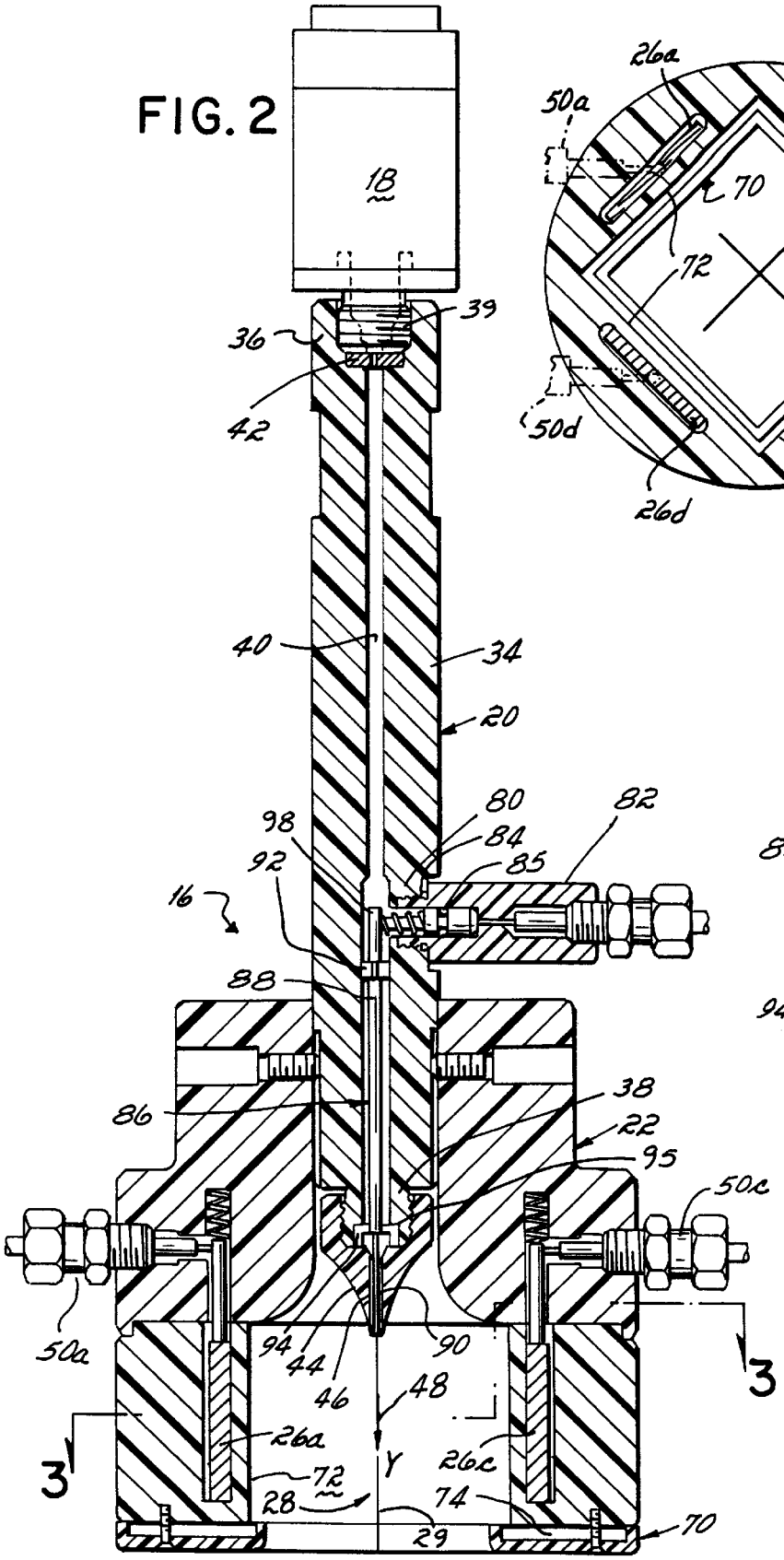
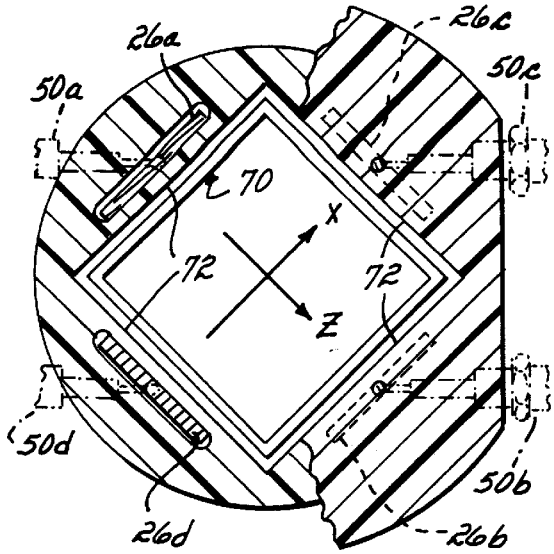
FIG. 3
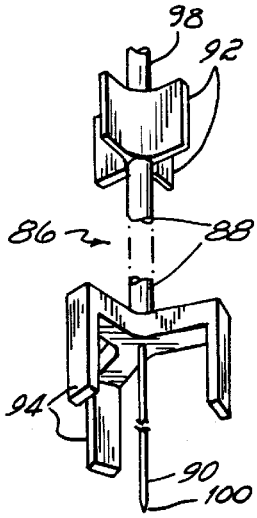
FIG. 4

LIQUID DISPENSING SYSTEM AND METHOD FOR ELECTROSTATICALLY DEFLECTING A CONTINUOUS STRAND OF HIGH VISCOSITY VISCOELASTIC NONCONDUCTIVE LIQUID

FIELD OF THE INVENTION

This invention relates generally to non-contact dispensing systems for applying high viscosity viscoelastic nonconductive liquid material onto a substrate and, more particularly, to a non-contact dispensing system for electrostatically causing a continuous strand of charged high viscosity viscoelastic nonconductive liquid discharged from a dispenser to move while in the air and thereby forming a desired bead formation on a substrate.

BACKGROUND OF THE INVENTION

Various types of dispensing devices are used to discharge liquids having different characteristics, such as temperature and viscosity. Such devices include both contact devices, in which a portion of the dispensing nozzle contacts the substrate, and non-contact devices, in which the nozzles are spaced from the substrate. Contact devices typically dispense beads or surface coatings of liquids such as heated thermoplastic liquids. Non-contact dispensing devices may dispense, for example, either strands or droplets of liquid.

When dispensing continuous strands of high viscosity viscoelastic nonconductive material such as hot melt adhesive, it is often desirable to introduce specific movement of the strand while it is in the air prior to its contact with the substrate so that it forms a desired pattern on the substrate. This allows the single strand of adhesive to spread over a wide area of the substrate and thereby achieve higher strength adhesive bonds and faster production speed. One manner of deflecting a dispensed continuous strand of hot melt adhesive involves the use of pressurized air jets. More specifically, certain dispensing nozzles incorporate air orifices disposed about a central liquid discharge orifice. The air jets discharged from these air orifices impact the continuous strand of adhesive upon its discharge from the central orifice and thereby impart a pattern, such as a swirled pattern, to the strand of adhesive. The swirled continuous strand of adhesive material then contacts the substrate forming a swirled pattern.

While the use of so-called swirl nozzles has adequately addressed the needs of many different applications, improvements related to precisely deflecting a dispensed continuous strand of highly viscous viscoelastic nonconductive liquid are necessary for various reasons. For example, proper placement of a continuous strand of such a liquid can be difficult when a substrate is irregularly shaped or, for example, in cases where the dispenser must place an adhesive bead close to an edge of the substrate. Also, orientation of the substrate relative to the dispenser can make accurate placement of the continuous strand difficult. For example, in certain applications the substrate may not be located directly below the dispenser.

Certain dispensing apparatus in the past have utilized one or more electric fields to affect the flight of dispensed, minute droplets of low viscosity liquid. This liquid may be atomized into a fine particle spray for providing a uniform coating on a substrate. This type of application, however, does not address the unique problems and issues involved when dispensing continuous strands of high viscosity viscoelastic, nonconductive liquids, such as hot melt adhesives. In such cases, it is not feasible to atomize the liquid and, in fact, at normal dispensing pressures of about 1500 psi and below, it is not possible to atomize such liquids. Moreover, the nonconductive nature of these liquids and the fact that they are not corona chargeable introduces problems associated with imparting a sufficient charge throughout the liquid.

It would therefore be desirable to provide dispensing system capable of dispensing a continuous strand of highly viscous viscoelastic nonconductive liquid, and deflecting the dispensed continuous strand in a precisely controllable manner. This may include introducing a desired pattern, such as a swirled pattern, to the continuous strand or deflecting the continuous strand to follow a desired path using one or more electric fields.

SUMMARY OF THE INVENTION

The present invention is an electrostatic liquid dispensing system for non-contact application of a continuous strand of high viscosity viscoelastic, nonconductive liquid, onto a substrate. The dispensing system more particularly comprises a dispenser including a nozzle with a discharge passage for dispensing the continuous strand of the high viscosity viscoelastic, nonconductive liquid under pressure and along a discharge path. A charging needle is positioned in the dispenser in such a manner that it contacts the pressurized liquid and exposes the liquid to an electrostatic charge. An electric field generator is positioned below and spaced from the nozzle outlet and generates one or more electric fields which cause movement of the charged continuous strand of high viscosity viscoelastic, nonconductive liquid before it is deposited onto the substrate. The charging needle is disposed within a constricted region of the dispenser. In the preferred embodiment, it is positioned within the discharge passage of the nozzle. In this manner, the needle imparts an electrostatic charge more fully throughout the nonconductive liquid just prior to its discharge from the outlet. As the liquid is nonconductive, this charge will not easily migrate through or from the liquid prior to reaching the one or more electric fields that deflect the continuous strand.

The electric field generator can more specifically comprise at least one deflection element, such as a plate, ball or rod, positioned adjacent the discharge path. In the preferred embodiment a plurality of deflection elements are positioned adjacent to the discharge path. For example, if a pair of deflection plates are used, they are spaced substantially parallel to each other and adjacent the discharge path. The discharge path passes between this pair of deflection elements and, therefore, the generated electric field deflects the continuous strand from this initial path of movement. The electric field generator preferably comprises two pairs of deflection elements spaced from the discharge path and opposed to one another. A power supply is operatively connected to the charging needle and a plurality of deflection power supplies are respectively connected to the plurality of deflection elements. One power supply with multiple outputs could be used as will be appreciated by one of ordinary skill in the art. A deflection controller is connected with the deflection power supplies and sends a deflection command to the deflection power supplies for operating the power supplies so as to cause deflected movement of the dispensed continuous strand. The deflection controller and the various deflection power supplies form a controller for establishing the positive or negative electric fields at specific times generated by each deflection element and used to move the continuous strand. Finally, the deflection controller includes a variable voltage control that applies a variable voltage to the one or more deflection power supplies for varying the deflection of the continuous strand of liquid.

The present invention is also a method for non-contact dispensing of a continuous highly viscous viscoelastic, nonconductive liquid strand onto a substrate in a desired pattern or at a specified location. The method comprises spacing a nozzle outlet of a dispenser from a substrate and electrostatically charging the high viscosity viscoelastic, nonconductive liquid within a discharge passage of the gun. The high viscosity viscoelastic, nonconductive liquid is then dispensed as a continuous charged strand from the nozzle along a discharge path. At least one electric field is generated around the discharge path. As the charged continuous strand passes through the electric field, it is deflected from the discharge path into a desired pattern. The deflected charged continuous strand is then applied to the substrate.

In addition to those mentioned above, various additional objects, advantages and features of the invention will become apparent to those of ordinary skill in the art upon review of the following detailed description of one preferred embodiment taken in conjunction with the accompanying drawings.

BRIEF DESCRIPTION OF THE DRAWINGS

Reference will now be made to the accompanying figures from which the novel features and advantages of the present invention will be apparent:

FIG. 2 is a longitudinal partial cross sectional view of the dispensing device shown in FIG. 1;

FIG. 3 is a cross-sectional view taken along line 3—3 of FIG. 2; and FIG. 4 is a fragmented perspective view of a charging assembly of the dispensing device of FIG. 2.

DETAILED DESCRIPTION OF THE PREFERRED EMBODIMENT

Figure 1:
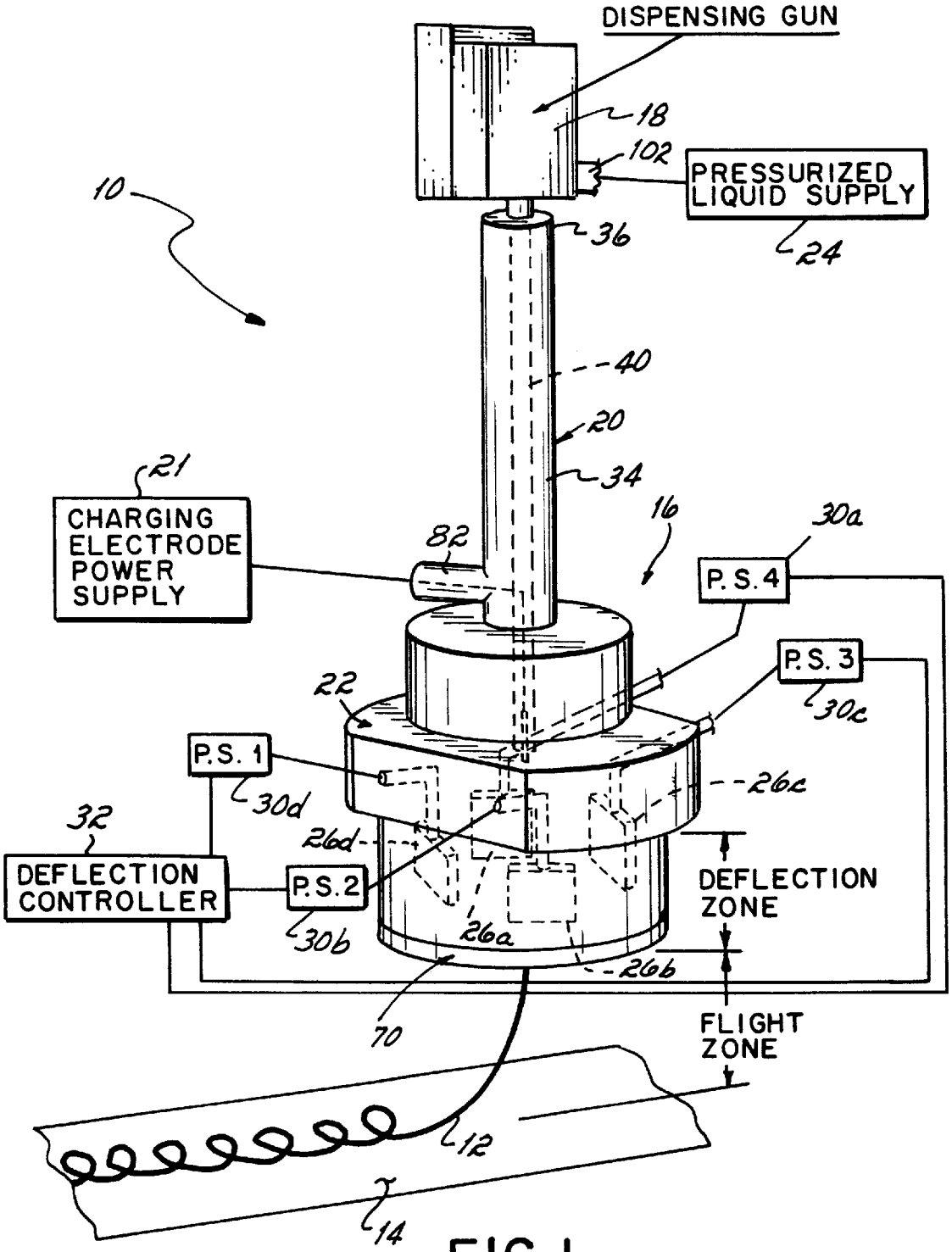
FIG. 1 is a schematic perspective depiction of a preferred electrostatic dispensing system mounted over a substrate.

Referring to FIG. 1, an electrostatic liquid dispensing system is shown in accordance with the principles of the present invention for dispensing a high viscosity viscoelastic, nonconductive liquid strand 12, such as hot melt adhesive, onto a moving substrate 14. The dispensing system 10 includes an electrostatic liquid dispensing device 16 and a dispensing gun or module 18. A suitable gun 18 for use in the present invention is commercially available from Nordson Corporation of Westlake, Ohio as the Nordson Model H200 Hot Melt Gun. The dispensing device 16 includes a dispensing member 20 and an electric field generator 22. A pressurized liquid supply 24 provides pressurized high viscosity viscoelastic, nonconductive liquid to the gun 18 which controllably passes the pressurized liquid to the dispensing member 20. An electrostatic charge is imparted to the pressurized liquid by a voltage supplied by a charging electrode power supply 21 to the interior of the dispensing member 20, as will be discussed below.

Liquid pressure propels the continuous charged high viscosity viscoelastic nonconductive strand 12 through the electric field generator 22. The continuous strand 12 is deflected in a "deflection zone" (FIG. 1) by an electric field generated by one or more of deflection elements 26*a*–26*d* positioned around a deflection cavity 28 (FIG. 2) within the electric field generator 22. Although deflection elements 26*a*–26*d* could be various shapes and sizes, the preferred embodiment comprises charging plates of rectangular shape each spaced approximately 1.5 inches from a discharge axis or path 29 of the dispensing member 20. The electric fields generated by deflection elements 26*a*–26*d* are powered by respective power supplies 30*a*–30*d* controlled by a control voltage provided from a deflection controller 32, which could be a general purpose computer having an interface card. The deflection controller 32 may include a conventional variable voltage control and thereby output a low DC voltage of approximately 0–10 V to the power supplies 30*a*–30*d* which, in turn, each provide a corresponding variable output voltage of approximately 0–50 kV to the corresponding deflection elements 26*a*–26*d*. This voltage may be increased or decreased in this range, for example, to vary the amount of deflection of liquid strand 12.

Changing the electric field within the deflection zone (FIG. 1) allows for controlled deflection of the continuous strand 12 as it discharges under pressure from the dispensing member 20. A region is preferably formed between the electric field generator 22 and the substrate 14 to allow for the flight of the liquid strand 12. This "flight zone" (FIG. 1) provides for additional deflection capability beyond the physical limits of the electric field generator 22 by allowing a horizontal velocity imparted to the continuous strand 12 to continue to deflect the continuous strand 12 with respect to the axis of the outlet in the absence of one or more electric fields. The imparted horizontal velocity to continuous strand 12 can create a deflection greater than the distance between discharge axis 29 and each of the elements 26*a*–26*d*. The deflection of continuous strand 12 is limited by air drag that reduces the horizontal velocity and by vertical acceleration from gravity that reduces the time that the continuous strand 12 can deflect outwardly in the flight zone.

Referring now to FIG. 2, the dispensing device 16 is shown in cross section in its preferred vertical orientation to illustrate dispensing and deflection components of the dispensing device 16. The dispensing member 20 includes an elongated body portion 34 having a gun receiving portion 36 at one end, a nozzle receiving portion 38 at the other end, and a liquid discharge passage 40 communicating between the gun receiving portion 36 and the nozzle receiving portion 38. The gun receiving portion 36 is configured to threadably mount to a threaded stem 39 of the gun 18. A restrictor 42 is interposed between the gun receiving portion 36 and a lower end of the gun stem for restricting flow of pressurized high viscosity viscoelastic nonconductive liquid dispensed from the gun 18. Alternatively, a metering pump could be mounted to gun 18 and used to variably control the rate of liquid flow through the liquid discharge passage 40. The nozzle receiving portion 38 threadably engages a nozzle 44 that has a discharge passage 46 communicating between liquid discharge passage 40 and the exterior of the dispensing device 16. Discharge passage 46 is aligned along discharge axis 29 to define a liquid discharge path 48 along a direction "y".

Referring now to FIG. 3, the arrangement of deflection elements 26*a*–26*d* is shown for generating electric fields generally orthogonal to discharge path 48. In the preferred embodiment of the present invention, a first pair of the deflection elements 26*d*, 26*c* generates an electric field generally in an "x" direction and a second pair of the deflection elements 26*a*, 26*b* generates an electric field generally in a "z" direction. Electrical power is applied to elements 26*a*–26*d* by deflection connectors 50*a*–50*d*, respectively, that are coupled to corresponding power supplies 30*a*–30*d*. FIGS. 2 and 3 show a vertical drip catcher 70 for narrowing the lowest portion of the deflection cavity 28. In the event that liquid discharge from discharge passage 46 contacts an inner surface 72 of the electric field generator 22 as a result of excessive deflection, the liquid discharge will travel into a drip catcher cavity 74 of the drip catcher 70. This excessive deflection could be caused by factors such as excessive voltage being applied to elements 26*a*–26*d*, or an electrostatic charge per mass of the liquid discharge being increased, such as by reducing the rate of discharge.

Referring again to FIG. 2, elongated body portion 34 has a charging receptacle 80 threadably engaging a charging connector 82. An external O-ring 84 and an internal O-ring 85 seal charging connector 82 from the pressurized liquid in discharge passage 40. While this construction has advantages of ease of repair, it is anticipated that charging conductor 82 could be permanently sealed into the body portion 34 or otherwise mounted without departing from the spirit and scope of the present invention. The charging connector 82 is operably connected to a conductive charging assembly 86 (FIGS. 2 and 3) which includes a charging electrode holder 88 connected to a charging electrode 90. The charging electrode holder 88 is held within discharge passage 40 by radially extending holder fingers 92 (FIGS. 2 and 4) that engage inner surfaces of discharge passage 40. The charging electrode holder 88 positions the charging assembly 86 along the longitudinal axis of the discharge passage 40, and resists deflection by the charging connector 82. The charging electrode holder 88 is also held within the discharge passage 40 by holder legs 94 (FIGS. 1 and 4) that are held in a cavity 95 formed in the end of nozzle receiving portion 38. The holder legs 94 are retained in cavity 95 by the nozzle tip 44. Charging conductor 82 includes a conductive member 96 that electrically couples to an upper conductive member 98 of the charging assembly 86.

Pressurized high viscosity viscoelastic nonconductive liquid passes around the charging assembly 86 and is electrostatically charged before being dispensed out of the nozzle discharge passage 46. The narrow cross sectional area of passage 46 in the vicinity of the charging electrode 90 provides a relatively large charging surface area relative to the moving volume of the liquid. The charging electric field generated by the charging assembly 86 is enhanced by a sharp point 100 formed at the tip of charging electrode 90.

In the preferred embodiment of the present invention, the charging electrode 90 is a slender needle made from cold-rolled steel which focuses the electric field at the tip of the charging electrode 90 proximate the narrow nozzle discharge passage 46. Needle 90 may be of various dimensions other than the illustrated elongated, slender shape. The electrode holder 88, elements 26*a*–26*b*, and restrictor plate 42 are also made from cold-rolled steel. The body portion 34 and nozzle 44 are made from a polyamide-imide material such as TORLON®, available from Amoco Corporation. The structural elements of the electric field generator 22, including the drip catcher 70, are made from DELRIN®, an acetyl homopolymer available from the E.I. du Pont de Nemours and Company.

In operation, the pressurized liquid supply 24 provides heated, pressurized high viscosity viscoelastic nonconductive liquid such as hot melt adhesive to the dispensing gun 18 through a suitable conduit 102. Dispensing gun 18 supplies the pressurized liquid to the elongated discharge passage 40 in an ON/OFF fashion as necessitated by the application. The intervening restrictor 42 and/or a metering pump provide a liquid flow rate in a range between about 0.5 and about 10 lbs./hour for hot melt adhesives, although other flow rates could be appropriate outside of this range for different applications. The electrode power supply 21 is may be set between 10–50 kV to impart an electrostatic charge on the charging electrode 90. For example, for 16 kV, the electrostatic charge would be 3–16 Coulombs/gram corresponding to a flow rate varying between about 0.5 and about 10 lbs./hour for the continuous strand 12.

The orientation and voltages of the elements 26*a*–26*d* within the electric field generator 22 will depend on the deflection pattern desired by the user. For example, with the configuration shown in the drawings, elements 26*a*–26*d* may be alternately turned on and off by deflection controller 32 to successively deflect liquid strand 12 in different, orthogonal directions. This will create a swirled pattern as shown in FIG. 1. Alternatively, deflection controller may provide a varying voltage to one or more of elements 26*a*–26*d* to cause a desired strand movement. Other numbers and configurations of deflection elements may be incorporated to produce different types of deflections or deflection patterns. For example, one deflection element may be used to repeatedly attract or repel liquid strand 12 in one direction by on/off or variable voltage control, while two opposed deflection elements may be used to alternately repel or attract liquid strand 12 in opposite directions to create a zig-zag bead pattern on a substrate. Other control options and patterns will be recognized by those of skill in the art.

While the present invention has been illustrated by a description of a preferred embodiment and while this embodiment has been described in some detail, it is not the intention of the Applicants to restrict or in any way limit the scope of the appended claims to such detail. For example, one alternative of the invention may include multiple nozzle orifices arranged along a common axis for dispensing multiple continuous strands in parallel onto a moving substrate. Additionally, the deflection controller 32 may vary the control voltages applied to one or more of the charging elements 26*a*–26*d* to impart complex movement or patterns to the continuous strand 12. It is further anticipated that the charging elements could also include member pairs having a vertical separation as well as a horizontal separation, allowing electric fields with components along discharge path 48. Additional advantages and modifications will readily appear to those skilled in the art. This has been a description of the present invention, along with the preferred methods of practicing the present invention as currently known.

However, the invention itself should only be defined by the appended claims, wherein we claim:

1. A non-contact liquid adhesive dispensing device for applying a continuous strand of high viscosity viscoelastic, nonconductive liquid adhesive onto a substrate, the device comprising:

a pressurized source of high viscosity viscoelastic, nonconductive liquid adhesive;

a dispenser having an inlet for receiving the pressurized high viscosity viscoelastic, nonconductive liquid adhesive;

an outlet for dispensing the continuous strand of high viscosity viscoelastic, nonconductive liquid adhesive along a discharge path and a passage for carrying the pressurized high viscosity viscoelastic nonconductive liquid adhesive between said inlet and said outlet;

said pressurized source of high viscosity viscoelastic, nonconductive liquid adhesive being pressurized to a level sufficient to cause said continuous strand of adhesive to be extruded from said outlet;

a charging needle positioned within said dispenser for contacting the high viscosity viscoelastic, nonconductive liquid adhesive and for imparting an electrostatic charge to the high viscosity viscoelastic, nonconductive liquid adhesive; and an electric field generator including at least first and second deflection elements positioned below and spaced from said outlet for generating separate electric fields to cause deflected movement of said continuous strand of high viscosity viscoelastic, nonconductive liquid adhesive away from said discharge path before said strand is deposited onto the substrate.

2. The dispensing device of claim 1, wherein said electric field generator includes first and second deflection power supplies having outputs respectively connected to said first and second deflection elements for applying a voltage thereto and generating the separate electric fields.

3. The dispensing device of claim 2, further comprising a deflection controller connected to said first and second deflection power supplies for varying said outputs connected respectively to said first and second deflection elements to respectively alter said electric fields.

4. A non-contact liquid adhesive dispensing system for applying a continuous strand of high viscosity viscoelastic, nonconductive liquid adhesive onto a substrate, the device comprising:

a pressurized source of high viscosity viscoelastic, nonconductive liquid adhesive;

an ON/OFF gun for dispensing the high viscosity viscoelastic, nonconductive liquid adhesive under pressure;

a nozzle body mounted to said dispenser gun and having a discharge passage with an inlet for receiving the high viscosity viscoelastic, nonconductive liquid adhesive dispensed from said gun and an outlet for dispensing the high viscosity viscoelastic, nonconductive liquid adhesive under pressure as a continuous strand onto the substrate;

said pressurized source of high viscosity viscoelastic, nonconductive liquid adhesive being pressurized to a level sufficient to cause said continuous strand of adhesive to be extruded from said outlet;

a charging needle positioned within said discharge passage for contacting the pressurized high viscosity viscoelastic, nonconductive liquid adhesive and for imparting an electrostatic charge to the high viscosity viscoelastic, nonconductive liquid adhesive;

an electric field generator including at least first and second deflection elements positioned below and spaced from said outlet for generating separate electric fields to cause deflected movement of said continuous strand of high viscosity viscoelastic, nonconductive liquid adhesive away from said discharge path before said strand is deposited onto the substrate; and a controller connected to said electric field generator for applying variable voltage thereto to alter said electric fields and thereby vary the deflection of the continuous strand of high viscosity viscoelastic, nonconductive liquid adhesive.

5. The dispensing device of claim 4 wherein said electric field generator includes first and second deflection power supplies having outputs respectively connected to said first and second deflection elements for applying a voltage thereto and generating the separate electric fields.

6. A method for dispensing a high viscosity viscoelastic, nonconductive liquid adhesive in a continuous strand onto a substrate using a liquid adhesive dispenser having a liquid adhesive discharge passage with an inlet for receiving a supply of the high viscosity viscoelastic, nonconductive liquid adhesive and an outlet for dispensing the high viscosity viscoelastic, nonconductive liquid adhesive under pressure as a continuous strand along a discharge path, the method comprising:

spacing the outlet from the substrate;

electrostatically charging the pressurized high viscosity viscoelastic, nonconductive liquid adhesive within the liquid adhesive discharge passage;

discharging the charged pressurized high viscosity viscoelastic, nonconductive liquid adhesive as a continuous strand from said liquid adhesive discharge passage and along said discharge path;

generating an electric field;

passing the charged high viscosity viscoelastic, nonconductive liquid adhesive strand through the electric field;

deflecting the charged high viscosity viscoelastic, nonconductive liquid adhesive strand from the discharge path with the electric field; and applying the deflected continuous high viscosity viscoelastic, nonconductive liquid adhesive strand onto the substrate.

* * * * *